United States Patent [19]

Knoke et al.

[11] Patent Number: 4,632,858

[45] Date of Patent: Dec. 30, 1986

[54] FILLER FLEECE MATERIAL AND METHOD OF MANUFACTURING SAME

[75] Inventors: Jürgen Knoke, Weinheim; Helmut Jäger, Fürth; Ludwig Dekant, Weinheim; Dieter Groitzsch, Hirschberg, all of Fed. Rep. of Germany

[73] Assignee: Firma Carl Freudenberg, Weinheim, Fed. Rep. of Germany

[21] Appl. No.: 666,568

[22] Filed: Oct. 30, 1984

[30] Foreign Application Priority Data

Feb. 17, 1984 [DE] Fed. Rep. of Germany ..... 3405669

[51] Int. Cl.[4] ..... B32B 31/26; D04H 1/48

[52] U.S. Cl. ..... 428/287; 156/308.2; 156/308.4; 428/288; 428/296

[58] Field of Search ..... 428/296, 288, 287; 156/308.2, 308.4

[56] References Cited

U.S. PATENT DOCUMENTS 4,129,675 12/1978 Scott ..... 428/296

4,508,113 4/1985 Maloney ..... 428/286

*Primary Examiner*—James C. Cannon

*Attorney, Agent, or Firm*—Felfe & Lynch

[57] ABSTRACT

The filler fleece material of the invention consists of a laminate of two layers of fleece containing bonding fibers. The thinner layer, which serves as a covering fleece, consists to at least 60% of thermoplastic bonding fibers which melt at the same or a lower temperature than those of the central fleece. This combination makes it possible, after the depositing of the fiber layers and the thermal consolidation of the central fleece, to perform a process for smoothing the cover layer, in which the laminate is exposed in a roller gap to a temperature that is above the fiber melting point of the cover fleece. The filler fleece material of the invention, on account of its smooth yet still sufficiently air-permeable cover layer, is no longer subject to fiber protrusion. Furthermore, the clinging of projecting fibers during application to textile surface materials is reliably prevented.

13 Claims, No Drawings

FILLER FLEECE MATERIAL AND METHOD OF MANUFACTURING SAME

BACKGROUND OF THE INVENTION

The invention relates to a two-layer filler fleece wherein the filler fleece material consists of a central fleece containing thermoplastic bonding fibers and a cover fleece. In addition, a method is described for the manufacture of such a filler fleece material.

Filler fleece materials of the above-specified kind are used for the back-lining of anoraks, poplin jackets and other such outer garments. They are normally spray-bonded; modern, especially soft filler fleece materials are held together by thermoplastic binding fibers. Particularly these last fleeces exhibit an annoying tendency to cling to the surface material, and therefore they cannot be used with roughened poplin material which is no longer gassed. Also, when the garments are worn, fibers work out through the surface material, and this is intensified by the necessary operations involved in the care of the garments.

Attempts have been made to overcome these disadvantages by stitching or quilting a light cover fabric or already bonded nonwoven cover material to the actual filler materials, or a textile layer that prevents the fibers from working through or clinging is overlaid by bonding (calendering).

This procedure is expensive and also disadvantageous because excessive calendering results in an excessively tight bonding of the fibers and hence in an excessively stiff product. Softness can be maintained by lighter pressures, but the fiber bonding is then too weak. A thermal spot-bonding, however, causes an ugly show-through of the bonding pattern, especially in the case of light surface materials.

It is the object of the invention to avoid the above-mentioned disadvantages with a novel filler fleece, without losing the outstanding properties of modern, especially soft filler materials. Furthermore, a method is to be devised which in an especially simple manner permits the manufacture of such filler fleeces.

THE INVENTION

The solution to this problem retains the basic idea of preventing work-through and clinging of the fiber-bonded central fleece by means of a second covering layer; it contains, however, the feature of the invention that the cover fleece has a specific weight of 4 to 20 g/m$^2$ and consists to at least 60% of thermoplastic bonding fibers which melt at the same or at a lower temperature than the bonding fibers of the central fleece, and that the cover fleece has a thin and porous surface smoothed by thermofusion. Particularly smooth, thin and air-permeable cover layers are achieved with specific weights of 8 to 14 g/m$^2$. For the formation of the surface film it may be advantageous for the cover fleece to consist to 100% of thermoplastic bonding fibers.

Bi-component fibers or monofilaments can advantageously be used as thermoplastic bonding fibers in accordance with the invention. Among the bi-component fibers, the high requirements of softness, easy film formation and porosity have thus been especially satisfied by polyethylene terephthalate-polyethylene or polypropylene-polyethylene. In the case of monofilaments, fibers of polyamide 6, polybutylene terephthalate, polyolefin, or copolyester melting at 110° to 190° C., or copolyamide, must be given preference with regard to easy working qualities and the required product qualities.

It is entirely sufficient for the filler fleece to be provided with the smooth, porous, fiber-protrusion-preventing layer on one side only, since this side is turned to the face material in the process, while the less fiber-protrusion-proof back side faces the lining material. All of the abovementioned difficulties which occur during the manufacture or during the wearing of a garment provided with a filler fleece are eliminated by the configuration of the new filler material in accordance with the invention.

In the manufacture of a filler fleece from a central fleece containing thermoplastic fibers and a covering fleece, the procedure of the invention is to deposit on the central fleece, in the same operation as the deposit of the latter, a cover fleece in the form of a fiber sliver having a specific weight of 4 to 20 g/m$^2$ and a thermoplastic bonding fiber content of at least 60%. The melting point of the bonding fibers must be equal to or lower than that of the central fleece. Monofilament or bi-component fibers can be used as bonding fibers. The material then passes through a flat thermofusion oven and is heated to the temperature that is necessary for the consolidation of the central fleece. Either after its exit from the thermofusion oven, or in an additional step, the laminate is gauged in a roller gap at such a temperature that the upper layer virtually melts, and a smooth, thin, but still air-permeable protective layer forms which is resistant to washing and cleaning. The fiber used in the central fleece must be so resistant to the temperature that the soft, fleecy consistency will be preserved.

The said process can be performed continuously and avoids the complicated bonding or quilting to a smooth, thin cover fleece or cover fabric.

The following examples are intended to serve for the explanation of the above procedure and are not to be considered to be limitations of the idea of the invention.

EXAMPLE 1

With two cards, a fleece of 70% nylon 66 fibers with a fineness of 3.3 dtex and 30% of a jacket-and-core bi-component fiber of nylon 66 (core) and nylon 6 (jacket), weighing 55 g/m$^2$, is deposited with a fineness of 3.3 dtex on a crosslayer. In the same operation, 12 g/m$^2$ of a nylon 6 fiber of 1.7 dtex is deposited on this fleece. The speed of movement of the web of material amounts to 12 m/min. This combined fleece is consolidated in a thermofusion oven at 225° C. and wound up. Then the laminate is gauged at a temperature of 225° C. between two steel rollers without pressure, with a gap of 2 mm. Thus an open, shiny protective layer is formed on the upper side, which slides very easily and prevents the fibers of the central fleece from penetrating it. In the application of the material, to poplins, for example, this side is turned toward the surface material, and the less penetration-proof back side is turned toward the lining.

EXAMPLE 2

The procedure is the same as in Example 1, with the difference that the superimposed fleece consists to 100% of a bi-component core-and-jacket fiber of 1.7 dtex composed of polyethylene terephthalate (core) and polyethylene (jacket). The gauging between the steel rollers must in this case be performed at a temperature of 170° C. The resultant cover layer is characterized by an especially advantageous combination of smoothness and permeability to air.

EXAMPLE 3

With two cards, 80 g/m$^2$ of a fleece of 70% of a polyethylene terephthalate fiber of a fineness of 1.7 dtex and 30% of a jacket-and-core bicomponent fiber of polyethylene terephthalate (core) and polyethylene (jacket) of 1.7 dtex is deposited on a crosslayer. During this same procedure, as was the case in Example 2, 12 g/m$^2$ of a 100% bicomponent core-and-jacket fiber of polyethylene terephthalate (core) and polyethylene (jacket) of a fineness of 1.7 dtex is deposited on this fleece. The web speed amounts to 10 m/min. This laminate is needled from the top on a needling loom (stroke: 500) with a 7 mm piercing depth using size 40 needles of 3½", and consolidated in a flat thermofusion oven at 180° C. The product can then be gauged with a steel-on-steel calender situated directly at the exit from the oven, without pressure, in a gap of 2.5 mm. The fleece then remains bulky, and an open, shiny layer forms, which is very slippery and effectively prevents penetration of fibers from the bulky central fleece through the surface material.

It will be understood that the specification and examples are illustrative but not limitative of the present invention and that other embodiments within the spirit and scope of the invention will suggest themselves to those skilled in the art.

We claim:

1. A filler fleece material comprising a laminate having a central fleece containing thermoplastic bonding fibers and a cover fleece, said cover fleece having a specific weight of 4 to 20 g/m$^2$ and consisting of at least 60% of thermoplastic bonding fibers which melt at the same or a lower temperature than the bonding fibers of the central fleece, said cover fleece having a thin and smooth porous surface formed by thermofusion without pressure in a gauged gap.

2. The filler fleece material of claim 1, wherein the cover fleece surface is smoothed by thermofusion.

3. The filler fleece material of claim 2, wherein the cover fleece has a specific weight of 8 to 14 g/m$^2$.

4. The filler fleece material of claim 3, wherein the cover fleece consists to 100% of thermoplastic bonding fibers.

5. The filler fleece material of claim 2, wherein the thermoplastic bonding fibers of the cover fleece are bi-component fibers of polyethylene terephthalate and polyethylene or of polypropylene and polyethylene.

6. The filler fleece material of claim 2, wherein the thermoplastic bonding fibers of the cover fleece are monofilaments which consist of polyamide 6, polybutylene terephthalate, polyolefin, or at 110°-to-190° C.-melting copolyester or copolyamide.

7. A method for producing a filler fleece material as a laminate from a central fleece containing thermoplastic fibers, and a cover fleece, comprising (a) in the same operation as the depositing of the central fleece, forming a laminate by depositing a cover fleece thereon as a fiber sliver with a specific weight of 4 to 20 g/m$^2$ and a thermoplastic bonding fiber content of at least 60%, the melting point of the bonding fibers being equal to or less than that of the fiber of the central fleece;

(b) heating the laminate for thermal consolidation of the central fleece, and then (c) smoothing the cover fleece surface by thermofusion without pressure in a gauged gap.

8. The method of calim 7, wherein the laminate is heated in a thermofusion oven.

9. The method of claim 8, wherein the smoothing of the covdr fleece takes place by guiding the material in a gauging operation through a roller gap at a temperature above the fiber melting point of the cover fleece.

10. The method of claim 8, wherein the smoothing of the covering fleece surface is performed in a separate operation after leaving the thermofusion oven.

11. The filler fleece material of claim 5, wherein the thermoplastic bonding fibers of the cover fleece are a mixture of bi-component fibers.

12. The filler fleece material of claim 6, wherein the thermoplastic bonding fibers of the cover fleece are a mixture of monofilaments.

13. The filler fleece material of claim 1, wherein the thermoplastic bonding fibers of the cover fleece are a mixture of bi-component fibers and monofiliaments.

* * * * *